US008723043B2

(12) United States Patent
Weiss et al.

(10) Patent No.: US 8,723,043 B2
(45) Date of Patent: May 13, 2014

(54) ELECTRIC CONDUCTOR

(75) Inventors: Michael Weiss, Benediktbeuern (DE); Peter Tremmel, Aichach (DE); Markus Völk, Gauting (DE)

(73) Assignee: W.E.T. Automotive Systems AG, Odelzhausen (DE)

( * ) Notice: Subject to any disclaimer, the term of this patent is extended or adjusted under 35 U.S.C. 154(b) by 685 days.

(21) Appl. No.: 12/447,998

(22) PCT Filed: Feb. 28, 2008

(86) PCT No.: PCT/DE2008/000352

§ 371 (c)(1),
(2), (4) Date: Apr. 30, 2009

(87) PCT Pub. No.: WO2008/104171

PCT Pub. Date: Sep. 4, 2008

(65) Prior Publication Data

US 2010/0044075 A1 Feb. 25, 2010

(30) Foreign Application Priority Data

Feb. 28, 2007 (DE) ..... 10 2007 010 145
Jun. 6, 2007 (WO) ..... PCT/DE2007/001000

(51) Int. Cl.
*H01B 5/00* (2006.01)

(52) U.S. Cl.
USPC ..... 174/117 M; 174/126.4

(58) Field of Classification Search
USPC ..... 174/113 C, 117 M, 102 SC, 126.2, 126.4
See application file for complete search history.

(56) References Cited

U.S. PATENT DOCUMENTS

| | | | | |
|---|---|---|---|---|
| 3,662,093 | A | 5/1972 | Wilson et al. | |
| 3,798,474 | A * | 3/1974 | Cassand et al. | 310/331 |
| 4,543,474 | A | 9/1985 | Horsma et al. | |
| 4,568,851 | A * | 2/1986 | Soni et al. | 310/330 |
| 5,969,229 | A | 10/1999 | Hori et al. | |
| 6,114,633 | A | 9/2000 | Duhancik | |
| 6,686,562 | B1 | 2/2004 | Weiss et al. | |
| 7,041,943 | B2 | 5/2006 | Michelmann | |

(Continued)

FOREIGN PATENT DOCUMENTS

| | | |
|---|---|---|
| DE | 1565643 A1 | 12/1970 |
| DE | 3832342 C1 | 7/1989 |

(Continued)

OTHER PUBLICATIONS

International Search Report, Application No. PCT/DE2008/000352, published Sep. 4, 2008, published as WO2008/104171.

(Continued)

*Primary Examiner* — Chau N Nguyen
(74) *Attorney, Agent, or Firm* — The Dobrusin Law Firm, P.C.

(57) ABSTRACT

This invention relates to an electrical conductor (25) which is composed at least partially of an electrically conductive material.

Figure 1:
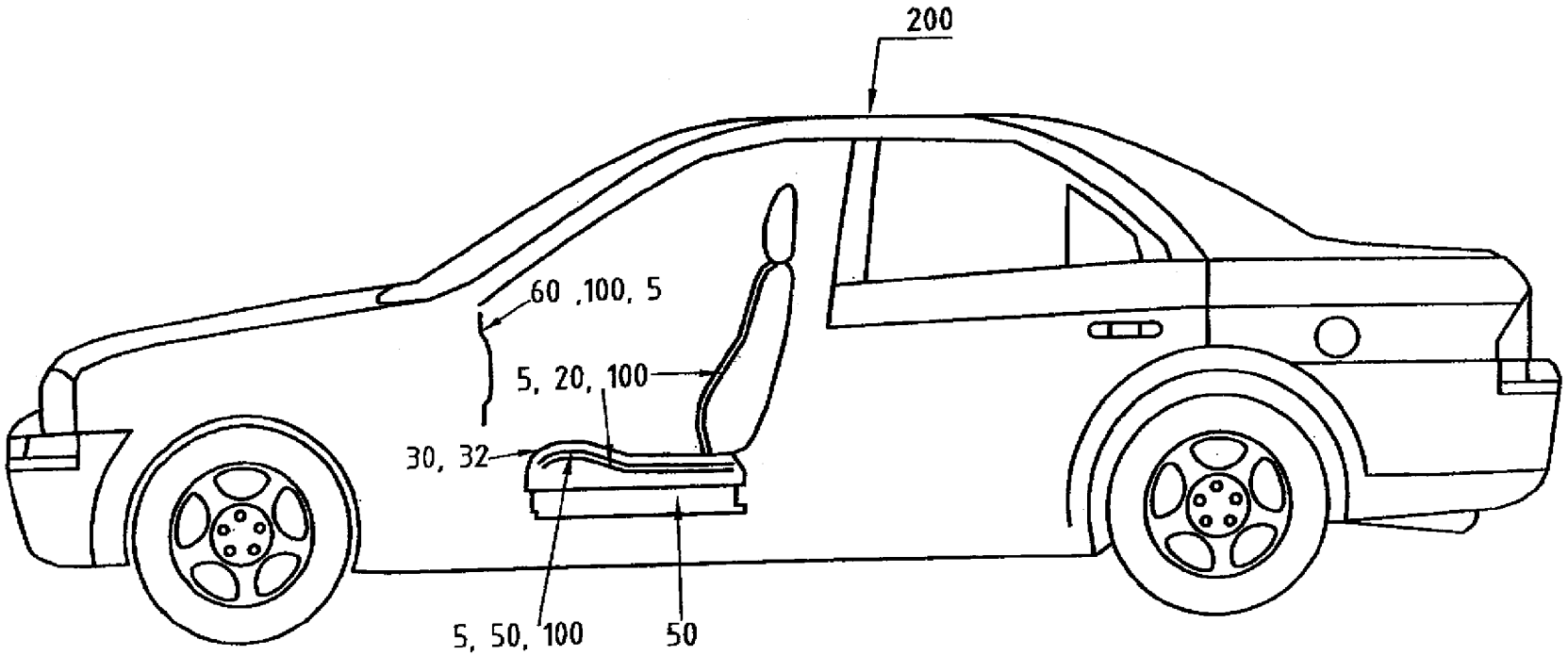

According to the invention, at least part of the electrical conductor (25) is provided with a protective layer (11) whose specific electrical conductivity is lower, at least locally, than that of the electrically conductive material of the conductor (25).

20 Claims, 3 Drawing Sheets

(56) References Cited

U.S. PATENT DOCUMENTS

| | | | | |
|---|---|---|---|---|
| 7,205,510 | B2 | 4/2007 | Howick | |
| 7,770,473 | B2 * | 8/2010 | Von Lilienfeld-Toal et al. | 73/862.68 |
| 2004/0060926 | A1 * | 4/2004 | Weiss | 219/544 |
| 2005/0109587 | A1 * | 5/2005 | Best et al. | 198/810.01 |
| 2007/0257027 | A1 | 11/2007 | Krobok | |
| 2007/0278210 | A1 | 12/2007 | Weiss | |
| 2007/0278214 | A1 | 12/2007 | Weiss et al. | |
| 2008/0010815 | A1 | 1/2008 | Bajic et al. | |
| 2008/0047733 | A1 | 2/2008 | Axakov et al. | |
| 2008/0290080 | A1 | 11/2008 | Weiss | |

FOREIGN PATENT DOCUMENTS

| | | | |
|---|---|---|---|
| DE | 19638372 | A1 | 3/1997 |
| DE | 10206336 | A1 | 9/2003 |
| DE | 202004020425.8 | | 7/2005 |
| EP | 0248324 | A2 | 12/1987 |
| GB | 1387621 | | 3/1975 |
| JP | 2001-217058 | A | 8/2001 |

OTHER PUBLICATIONS

Co-pending U.S. Appl. No. 11/085,644, filed Mar. 31, 2005, now U.S. Patent No. 7,205,510.

Co-pending U.S. Appl. No. 11/776,869, filed Jul. 12, 2007, published as 2008/0010815.

Co-pending U.S. Appl. No. 11/842,540, filed Aug. 21, 2007, published as 2008/0047733.

Co-pending U.S. Appl. No. 09/642,167, filed Aug. 18, 2000, now U.S. Patent No. 6,686,562.

Co-pending U.S. Appl. No. 10/598,453, filed Mar. 4, 2005, published as 2007/0278214.

Co-pending U.S. Appl. No. 11/800,669, filed May 7, 2007, published as 2007/0257027.

Co-pending U.S. Appl. No. 11/803,486, filed May 15, 2007, published as 2007/0278210.

Co-pending U.S. Appl. No. 12/096,266, filed Jun. 5, 2008, published as 2008-0290080.

Co-pending U.S. Appl. No. 12/233,649, filed Dec. 12, 2008.

* cited by examiner

Figure 2
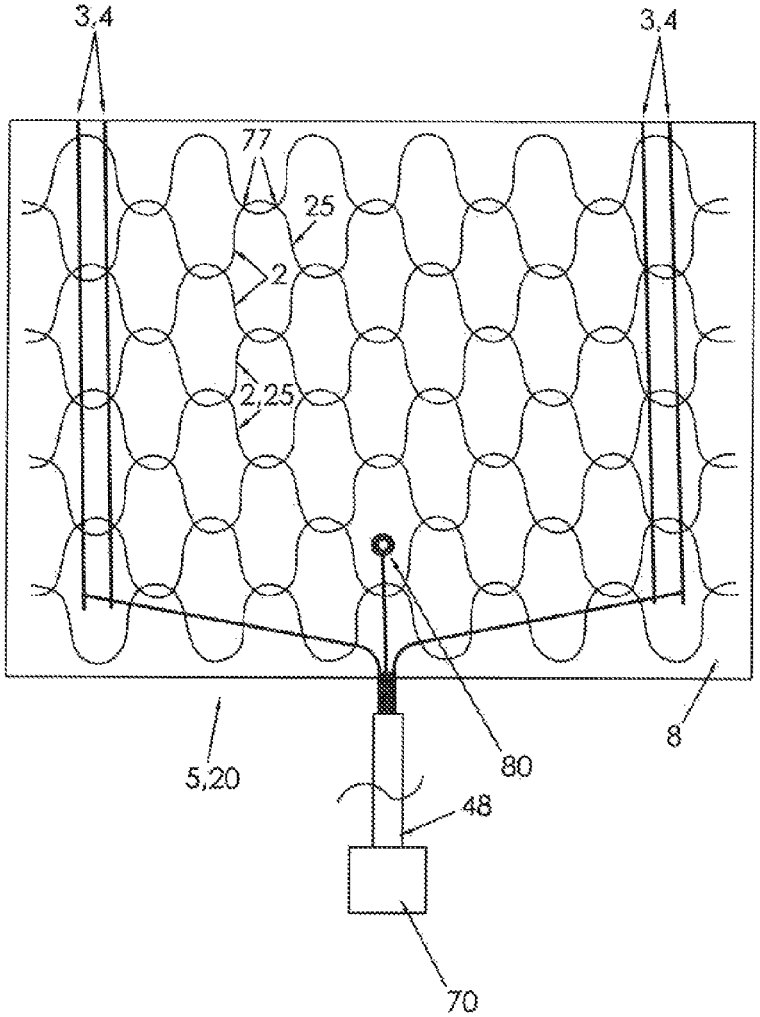
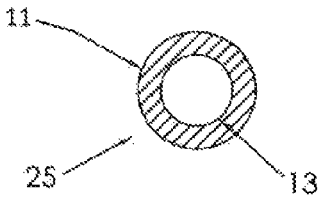
Figure 2A
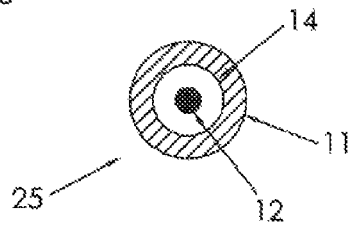
Figure 2B

ELECTRIC CONDUCTOR

CLAIM OF BENEFIT OF FILING DATE

The present application claims the benefit of the filing date of PCT Application Serial No. PCT/DE2008/000352 (filed Feb. 28, 2008) (Published as WO 2008/104171); DE 10 2007 010 145.9 (filed Feb. 28, 2007); and PCT/DE2007/001000 (filed Jun. 6, 2007), the contents of which are hereby incorporated by reference in their entirety.

This invention relates to an electrical conductor according to the preamble of claim 1 and to its use in heating elements, sensors, seats and vehicles.

PRIOR ART

It is known practice to silver-plate copper conductors in order to protect them against corrosion. However, unless the silver coating is impervious, the copper is still susceptible to attack. Moreover, the silver diffuses with time into the copper. This results in the formation of a boundary layer comprising a Ag—Cu alloy, which is extremely brittle. Fractures in this boundary layer form incipient cracks that likewise endanger the conductor.

Jacketed wires, as they are generally known, may be used to overcome this problem. In this case, electrical conductors are provided with a steel core and a copper jacket, as disclosed in DE 196 38 372 A1 or DE 102 06 336 A1. A jacketed wire comprising a platinum jacket and a core made of a material containing precious metal is known from DE 38 32 342 C1. A major disadvantage of this material combination is the high cost. Moreover, the corrosion resistance of copper jackets is not always sufficient for certain applications.

JP 2001-217058 discloses a heating conductor in which a plurality of carbon fibers is jacketed with heat-shrinkable tubing. However, an assembly of this kind is not very fracture-proof.

DE 20 2004 020 425.8 describes a conductor with a plastic core and a metallic coating. The invention described here is intended to further improve the corrosion resistance of a conductor of this kind.

SUBJECT OF THE INVENTION

To enrich the prior art, an electrical conductor according to claim 1 is therefore proposed. Thanks to its special make-up, this conductor is protected against functional impairment by corrosion even when used in damp and saline environments. This is because a conductive protective layer imparts corrosion resistance and load capability.

Further advantageous embodiments are evident from the dependent claims and the following description of the drawings.

DRAWINGS

Details of the invention are explained in the following. These explanations are intended to elucidate the invention. However, they are only of exemplary nature. The scope of the invention naturally allows for one or more of the described features to be omitted, modified or augmented. And it goes without saying that the features of different embodiments can be combined with each other. Reference will be made hereinafter to:

FIG. 1 A partially cut-away side view of a vehicle with a heating element and sensor FIG. 2 Top view of an electric heating element according to FIG. 1

Figure 3:
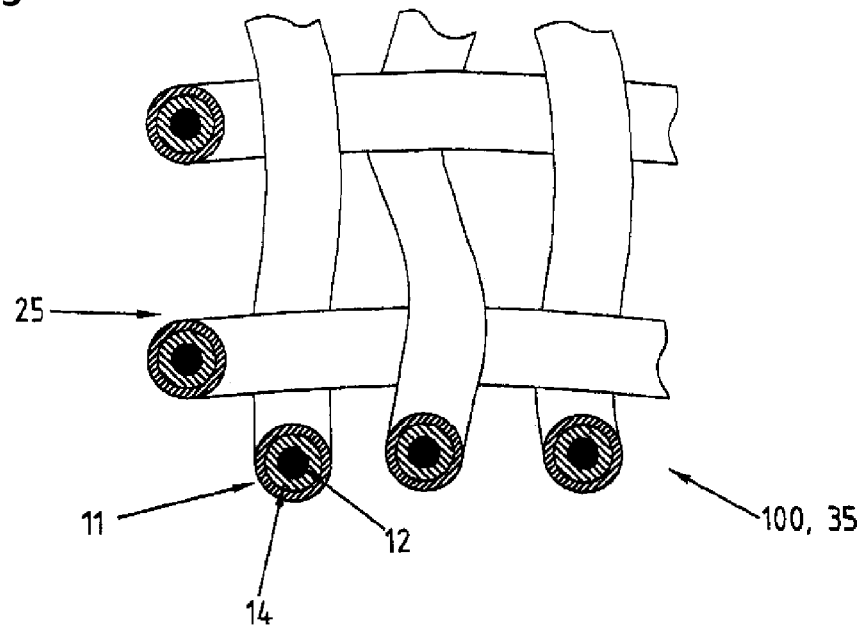

FIG. 3 Top view of an enlarged excerpt of a textile electrical conductor

Figure 4:
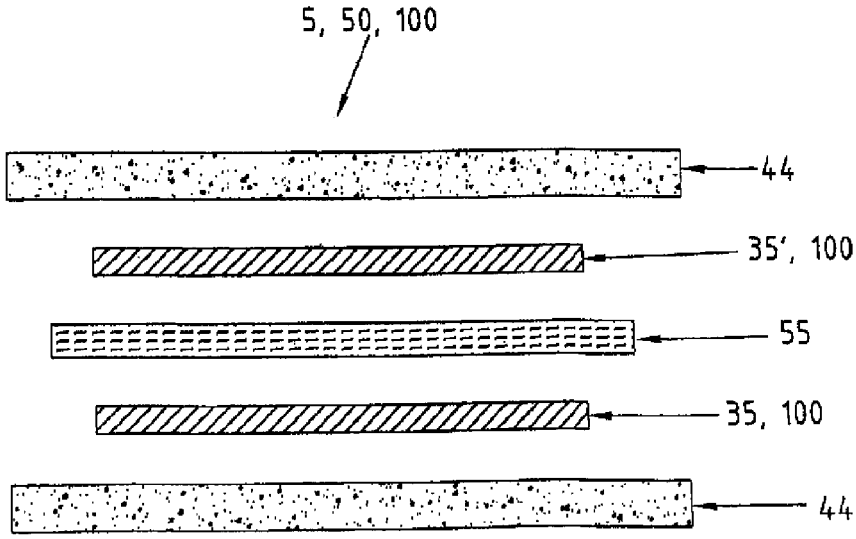

FIG. 4 Cross-section through a capacitive sensor with two textile electrodes

DESCRIPTION OF THE INVENTION

FIG. 1 shows a vehicle 200.

In it, various functional elements 5 may be provided, e.g. a seat heating, a seat-occupancy detection means or a keypad 60, which make a certain function such as heating, pressure detection or switching available pointwise or in two dimensions in certain zones of the vehicle interior.

To this end, at least one of the functional elements 5 is provided with at least one electrical conductor 25 according to FIG. 2, 2*a*, 2*b* or 3.

This conductor may be, for example, a heating conductor 2, a contact conductor 3, an electric cut-out and/or a connection line 48.

It is arranged in contact with, in or near to the functional zone, e.g. at least partially in contact with and/or in a seat cover 30.

It may be of planar configuration or, as in the embodiments of FIGS. 2 and 3, strand-shaped. A strand is a longish structure whose longitudinal dimensions by far exceed its cross-sectional dimensions. Preferably, the two cross-sectional dimensions are approximately the same size. The structure preferably has bending-elastic properties, but is in a solid state.

At least one conductor 25 may be configured as flat material 100, e.g. as film. In the embodiment of FIG. 2, a non-woven fabric of synthetic fibers is provided. Preferably, a plurality of conductors 25 is provided, which preferably meander beside one another and/or are connected up electrically in parallel. They are anchored to the non-woven fabric by sewing or knitting, for example. In the embodiment of FIG. 2, each conductor 25 is located at an average distance of about 2 cm from the next conductor 25, and runs approximately parallel thereto. "Parallel" means that the distance between two conductors remains, on average, about the same along their length.

It is also possible, according to FIG. 3, to provide a plurality of conductors 25, which together, at least in part, form a flat material 100.

A flat material 100 of such kind may feature, for example, a textile, a multiple- or single-thread knitted fabric, a woven or non-woven fabric, a flexible thermoplastic or an air-permeable material, and/or may be made up at least partially of such a material.

It is expedient if at least one electrical conductor 25 features at least one support 12 in order to increase the mechanical stability of the conductor 25. It may extend in several dimensions. Preferably, however, it runs in essentially two, or, as in FIGS. 2 and 3, in one main direction and is configured, for example, as the core of a conductor strand.

It may be to advantage that the support 12 is manufactured at least partially from a preferably elastic, temperature-stable and tear-resistant plastic, preferably at least partially, but more preferably entirely, from carbon fibers, polypropylene, a thermoplastic or polyamide and/or glass fiber, and/or at least partially from copper and/or from steel. The term "plastic" refers to every synthetic, non-naturally occurring material, in particular polymers and substances derived therefrom, such as carbon fibers.

It may be practical if the material of the support 12 is spinnable or capable of being drawn (out) into filaments or wires, preferably to filaments which are less than 100 μm thick, preferably less than 10 μm, preferably less than 1 μm, preferably less than 0.1 μm, preferably less than 0.01 μm.

It may be to advantage that a support for a conductor 25, in particular a heating conductor as in FIG. 2, is composed at least partially, essentially entirely, of a thermoplastic material, preferably a plastic, preferably polyamide, polyester, Kapton or, as here, polyimide. This permits a cost-effective assembly.

Moreover, fibers of this kind are soft and neither pointed nor brittle. As a result, it is possible to operate neighboring systems (e.g. seat-occupancy detection) safely.

It may be to advantage that the electrical conductivity of at least one electrical conductor 25 is at least temporarily reduced if the temperature thereof, at least locally, is between 200° C. and 400° C., preferably between 220° C. and 280° C. By this means, the heating element's surroundings can be prevented from heating up to an impermissibly high temperature. It may be practical that at least part of, preferably substantially all of, the electrical conductor 25 is interrupted, preferably irreversibly, within the cited temperature range.

It may be to advantage that the electrical resistance of the electrical conductor 25 is between 0 and 3 Ω/m, preferably between 0 and 2 Ω/m, preferably between 0.1 and 3 Ω/m, preferably between 0.2 and 0.5 Ω/m.

At least one electrical conductor 25 features at least one conducting layer 14.

This conducting layer 14 may be essentially planar, e.g. in the form of a film coating. However, the conducting layer 14, may also be configured as a coating layer that surrounds at least part of an internal strand, e.g. a filamentary support 12. At customary operating temperatures (approx. −20° C. to approx. +90 C) the specific electrical conductivity of the conducting layer and/or of the electrically conductive components of the conductor and/or of the protective layer is between $100\times10^{6}$ S/m and $10^{-8}$ S/m, preferably between $62\times10^{6}$ S/m and $10^{-3}$ S/m, and the specific electrical conductivity of the protective layer is at least 10 times, preferably 100 times, preferably 1,000 times greater than that of the conducting layer and/or of the conductor or its conductive components, preferably being between $10^{3}$ and $10^{-3}$ S/m.

The term "layer" refers to any material configuration, especially flat materials, that extends predominantly in two dimensions and that preferably, but not necessarily, is flat and flexible. The material configuration preferably forms a continuous surface, but may also be perforated, e.g. like a knitted spacer fabric, netting, a tubular system or foam.

A coating layer is a layer which, directly or indirectly, sheaths, i.e. encases, at least part of an object but is not necessarily the outermost layer encasing the object.

Nickel, gold, silver, copper or a gold/silver alloy are particularly suitable materials for the conducting layer 14. These may be applied, in particular, by an electroplating process. The sheath is very ductile and thus highly flexural-fatigue resistant over a long service period.

The conducting layer 14 preferably has a thickness between about 0.01 μm and about 3 mm. Depending on the application and desired resistance, it is between 0.1 μm and 0.5 mm, preferably between 0.1 μm and 10 μm for heating conductors, for example, and between 5 μm and 1 mm for conductors of low total resistance, for example.

It is to advantage if the material of the conductor support 12 has greater flexural-fatigue resistance and/or lower tensile or compressive strength than the material of the conducting layer 14.

In the case of threads, for example, the conducting layer 14 may be applied before they are processed further. However, in the case of a finished article such as a textile, it may also be applied to one or more supports 12 by spraying or dipping.

At least part of at least one electrical conductor 25 is provided with a protective layer 11. The protective layer 11 is preferably composed at least partially of a material that is chemically, in particular electrochemically, only very slightly reactive. By this is meant that under normal operating conditions, this material essentially retains its chemical composition and its atomic structure. As a result, an underlying conducting layer 14 is protected against corrosion. The protective layer is preferably resistant to mechanical wear. It is applied, for example by extrusion, onto the conducting layer 14 and/or the conductor 25. It may also be applied as a lacquer. Lacquer is a liquid or powder-form coating material that is applied in a thin layer to objects and that hardens by means of chemical or physical processes (e.g. evaporation of the solvent) to form a continuous film. Powder lacquers, suspensions of lacquer particles in water, radiation-curing lacquer systems and polyurethane lacquers are especially suitable.

At least in parts, the protective layer 11 is composed of a material that is at least conditionally electrically conductive, preferably of a material that is chemically or electrochemically only very slightly reactive. Preferably, at least in parts, its electrical conductivity (especially its specific electrical conductivity) is lower than that of a conducting layer 14 of the conductor 25. Its resistance, at least in sections, in the transverse direction of the conductor 25 is preferably at least of a similar dimension as that of the conductor 25 in its longitudinal direction. As a result, electrolytic reactions are distributed uniformly over the entire conductor surface, and any current concentration at possible defects in the protective layer 11 are avoided. Suitable materials here include, for example, electrically conductive plastics (e.g. intrinsically conductive plastics), platinum, soot, graphite in the form of carbon, carbon fibers, nanotubes, diamond, stainless steel or passivated or oxidized metals. The electrically conductive material may constitute a substantial share of the conducting layer. It may also be embedded as particles in a matrix of another material which is electrochemically only very slightly reactive. The size of the particles is such that one of their dimensions, preferably their diameter, is approximately between $10^{-6}$ and twice the thickness of the coating, preferably between 1 nm and 10 μm, preferably between 50 nm and 1 μm. The particles are, for example, fibrous or spherical.

Especially with regard to its thickness, conductivity and thermal stability, the protective layer 11 is preferably configured such that, without removing the protective layer 11, the conductor 25 and/or the flat material 100 are or can be electrically contacted, for example by means of connection lines 48 or electrodes 4, with current flowing through the protective layer 11. However, the protective layer 11 may also be removed, at least locally, in order to ensure better contact with the conducting layer 14.

Provision may be made for the surface of at least one conductor 25 to be coated entirely or at least partially with an electrically conductive or also a poorly conductive material, in particular entirely or at least partially with a plastic and/or a lacquer and/or entirely or at least partially with polyurethane, PVC, PTFE, PFA and/or polyester. Heating conductors and sensor conductors are protected in this way against corrosion. Provided the coating is sufficiently thin, their functionality is not changed substantially.

The coating according to the invention is also particularly suitable for protecting contact conductors, especially such contact conductors as are connected up to a plurality of components to be contacted (e.g. heating conductors) for the electrical contacting thereof. In many instances, contact conductors of this kind cannot be insulated because it would be too tedious to remove the insulation layer again at every contact point.

If such a contact conductor is covered with a coating whose electrical resistance is low and whose corrosion resistance and ability to keep out interfering substances are high, this contact conductor can make electrical contact with numerous consumers along its length, also between its ends, without the insulation having to be removed.

A protective layer 11 of this kind is preferably between 1 and 300 nanometers thick, preferably between 10 and 100. Polyurethane, polyacrylic, polycarbonate, polyester, FR-4, polypropylene and/or polystyrene are particularly suitable for this purpose. During operation, the electrical conductor is preferably connected up for at least some of the time to an electrical voltage of 5-50 V against earth, preferably 12 V±2. The effect of applying this voltage is that when another electrical conductor (e.g. a heating conductor) is arranged in contact with the coated conductor, a breakdown removes the protective layer 11 locally and establishes electrical contact, too, between the two conductors.

Provision may also be made for the protective layer 11 to have a thickness between 300 nanometers and 400 micrometers. In this case it is expediently made, at least in part, of a brittle material, and/or a material that is easily scratched off. It is then possible, in the event of another conductor being placed upon or intersecting the coated conductor, for the protective layer to be removed locally by mechanical loading (e.g. when the heating element is used). To this end, the material of the protective layer 11 preferably has—at least locally—an absolute hardness between 0 and 6.5, preferably between 1 and 5.

Provision may also be made, however, for the protective layer to be electrically conductive. In this case, at least in the area of a contact location, it preferably has a resistance between 0 and 100Ω, preferably 1 mΩ to 50Ω, in the radial direction of the (round) conductor (or perpendicular in the case of planar conductors). Suitable materials for this purpose include, for example, polyurethane, polyester and/or polyacrylic, in each case with added graphite particles and/or precious metal particles. Intrinsically conductive plastics are also suitable. The layer thickness here is preferably between 300 nanometers and 2 millimeters, preferably between 300 nanometers and 50 micrometers, preferably between 300 nanometers and 10 micrometers.

FIG. 2 shows an electrical heating element 20 with a flat heating support 8 and, arranged thereon, a pair of spaced electrodes 4 which are approximately parallel to one another and are mutually connected via a plurality of heating conductors 2. The heating conductors 2 are arranged approximately parallel to one another on the heating support 8, and are connected up electrically in parallel. Provision is made for at least some of the heating conductors 2 to be interlinked. This is achieved by arranging for at least some of the heating conductors 2 to contact each other, at least in some cases electrically, at contact locations 77 between their ends. As a result, localized heating-conductor malfunctions caused, for example, by localized damage during sewing or by vandalism, do not disrupt the operation of the heating element 20 because in the event of a localized failure of individual heating conductors 2, the heating current is distributed to neighboring heating conductors. The electrodes 4, for their part, are connected up to a current source 70 via electrical connection lines 48. Both the heating conductors and the contact conductors 4 may feature a core 13 of solid metal wire (FIG. 2 *a*). However, they may also feature a support 12 with a conductive layer 14, as shown in FIG. 2 *b*. Preferably, they are surrounded by a protective layer 11.

It is useful for the heating element to additionally feature a temperature sensor 80 that interrupts a current supply to the heating element 20 at temperatures between 60° C. and 80° C.

It may be expedient for the heating element to be installed in a vehicle seat, a steering wheel, an armrest, a seat pad, an electric blanket, or the like.

FIG. 3 shows a flat material 100 which is composed at least partially, preferably substantially, of conductors 25. At least some of these electrical conductors 25 feature a strand-shaped support 12. This is surrounded by a conductive layer 14. This, in turn, is surrounded by a protective layer 11. A flat, electrically conductive woven material 100 of this kind may be used as a heating textile or, like here, as a sensor electrode 35 in a capacitive sensor 50.

FIG. 4 shows a cross-section through a sensor 50 of this kind. The sensor 50 features two flat materials 100 which serve as sensor electrodes 35, 35' in a capacitor. These are spaced apart from one another by a flat, flexible dielectric 55, composed, for example, of plastic film or leather. The upper and lower sides of the thus-formed capacitor are each covered by a covering layer 44.

The change in the capacitor's capacity caused by compression of the dielectric 55 may then be used to detect a user on a monitored seat surface 32. It is also possible to measure field changes caused by a person approaching one of the sensor electrodes 35.

REFERENCE NUMERALS

2 Heating conductor
3 Contact conductor
4 Electrodes
5 Functional elements
8 Heating support
11 Protective layer
12 Support
14 Conducting layer
20 Heating element
25 Conductor
30 Seat cover
32 Monitored surface
35 Sensor electrode
44 Covering layer
48 Connection lines
50 Sensor
55 Dielectric
60 Keypad
70 Current source
77 Contact locations
80 Temperature sensor
100 Flat material
150 Seat
200 Vehicle

The invention claimed is:

1. An electrical conductor comprising:

at least one support;

a conducting layer comprised of gold, silver, nickel, chrome, copper, platinum, nickel with a phosphorus fraction, or an alloy thereof, the conducting layer having a thickness between 0.1 μm and 10 μm, disposed on the at least one support; and a conductive protective layer disposed over the conducting layer, the conductive layer comprising polyurethane, polyester, or polyacrylic, each with added graphite particles, precious metal particles, or both;

wherein the at least one support comprises a temperature-stable and tear-resistant plastic with a greater flexural-fatigue resistance, a lower tensile strength, or both, than that of the conducting layer;

further wherein the conductive protective layer has a specific electrical conductivity between $100\times10^{6}$ S/m and $10^{-8}$ S/m and is less conductive than the conducting layer further;

wherein the electrical conductor is an electric heating element.

2. The electrical conductor according claim 1, wherein the conductive protective layer has a layer thickness between 300 nanometers and 10 micrometers.

3. The electrical conductor according to claim 2, wherein the protective layer includes platinum, soot, graphite in the form of carbon, carbon fibers, nanotubes, diamond, stainless steel or passivated or oxidized metals.

4. The electrical conductor according to claim 1, wherein a surface of the conducting layer material is passivated, passivatably oxidized and/or chromated.

5. The electrical conductor according to claim 1, wherein the conductive protective layer resistance, at least in sections, in the transverse direction of the conducting layer is at least of a similar dimension as that of the conducting layer in its longitudinal direction.

6. The electrical conductor according to claim 1, wherein the electric heating element disposed in an automotive seat has a custom a operating temperature between 6° C. to 90° C.

7. The electrical conductor according to claim 1, wherein the protective layer that is slightly chemically reactive.

8. The electrical conductor according to claim 1, wherein the electrical conductivity of at least one electrical conductor is at least temporarily reduced if the temperature thereof, at least locally, is between 200° C. and 400'C.

9. The electrical conductor according to claim 1, wherein the protective layer is composed as least partly of a material that retains the chemical composition under normal operating conditions to protect the conducting layer against corrosion.

10. The electrical conductor according to claim 9, wherein normal operating conditions are customary operating temperatures between 20° C. to 90° C.

11. The electrical conductor of claim 9, wherein the support is manufactured at least partially from copper and/or steel.

12. The electrical conductor according to claim 1, wherein the support is manufactured entirely from carbon fibers, polypropylene, a thermoplastic, polyamide, and/or glass fiber.

13. An electric heating element comprising:

a plurality of electrical conductors comprising:

at least one support that is manufactured entirely from carbon fibers, polypropylene, a thermoplastic, a polyamide, and/or glass fiber;

a conducting layer comprised of a material consisting of gold, silver, nickel, chrome, copper, platinum, nickel with a phosphorus fraction, or an alloy thereof, the conducting layer having a thickness between 0.1 μm and 10 μm, disposed on the at least one support; and a conductive protective layer disposed over the conducting layer;

wherein the at least one support comprises a temperature-stable and tear-resistant plastic with a greater flexural-fatigue resistance, a lower tensile strength, or both, than that of the conducting layer;

further wherein the conductive protective layer has a specific electrical conductivity between $100\times10^{6}$ S/m and $10^{-6}$ S/m and is less conductive than the conducting layer further wherein the electrical conductor is an electric heating element, wherein the protective layer is slightly chemically reactive, wherein the conductive protective layer includes platinum, soot, graphite in the form of carbon, carbon fibers, nanotubes, diamond, stainless steel or passivated or oxidized metals, and wherein the electrical conductivity of at least one electrical conductor is at least temporarily reduced if the temperature thereof, at least locally, is between 200° C. and 400° C.

14. The electric heating element according to claim 13, wherein the conductive protective layer comprises polyurethane, polyester, or polyacrylic, and a layer thickness between 300 nanometers and 10 micrometers.

15. The electric heating element according to claim 14, wherein the heating element includes a temperature sensor that interrupts a current supply to the heating element at a temperature between 60° C. and 80° C.

16. The electric heating element according to claim 13, wherein a surface of the conducting layer material is passivated, passivatably oxidized and/or chromated.

17. The electric heating element according to claim 16, wherein the support is spinnable or capable of being drawing into filaments which are less than 100 μm thick.

18. The electric heating element according to claim 13, wherein the conductive protective layer resistance, at least in sections, in the transverse direction of the conducting layer is at least of a similar dimension as that of the conducting layer in its longitudinal direction.

19. The electric heating element according to claim 13, wherein the electric heating element disposed in an automotive seat has a customary operating temperature between 20° C. to 90° C.

20. The electric heating element according to claim 13, wherein the electric heating element includes a flat heating support that has a pair of spaced apart electrodes that are connected via the plurality of electric heating conductors, and wherein the plurality of electric heating conductors contact each other, at least in some cases electrically at contact locations between ends of the electric heating conductors.

* * * * *

UNITED STATES PATENT AND TRADEMARK OFFICE

CERTIFICATE OF CORRECTION

PATENT NO. : 8,723,043 B2
APPLICATION NO. : 12/447998
DATED : May 13, 2014
INVENTOR(S) : Weiss et al.

It is certified that error appears in the above-identified patent and that said Letters Patent is hereby corrected as shown below:

In the Claims

Column 7, Line 30, delete "between 6°C. to 90°C." insert --between 20°C. to 90°C.--

Column 8, Line 12, delete "and $10^6$ S/m and is less" insert --and $10^{-8}$ S/m and is less--

Signed and Sealed this
Nineteenth Day of August, 2014

Michelle K. Lee

Michelle K. Lee
*Deputy Director of the United States Patent and Trademark Office*